US006250274B1

(12) United States Patent
Deane

(10) Patent No.: US 6,250,274 B1
(45) **Date of Patent: *Jun. 26, 2001**

(54) INTERNAL COMBUSTION ENGINE HAVING AN INCREASED LUBRICATING OIL CAPACITY AND/OR INCREASED GRADIABILITY

(75) Inventor: Daniel Deane, Cambridgeshire (GB)

(73) Assignee: Perkins Engines Company Limited, Peterborough (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,539

(22) PCT Filed: Aug. 19, 1998

(86) PCT No.: PCT/GB98/02401

§ 371 Date: Mar. 25, 1999

§ 102(e) Date: Mar. 25, 1999

(87) PCT Pub. No.: WO99/09304

PCT Pub. Date: Feb. 25, 1999

(30) Foreign Application Priority Data

Aug. 19, 1997 (GB) ..... 9717593

(51) Int. Cl.[7] ..... F01M 1/00
(52) U.S. Cl. ..... 123/196 R
(58) Field of Search ..... 123/196 R, 195 C

(56) References Cited

U.S. PATENT DOCUMENTS

| | | | | |
|---|---|---|---|---|
| 3,100,028 | | 8/1963 | Booth et al. | 184/106 |
| 3,101,129 | | 8/1963 | Hulten | 184/106 |
| 4,270,497 | | 6/1981 | Valerio | 123/195 |
| 4,519,348 | | 5/1985 | Hamilton | 123/195 |
| 4,524,735 | | 6/1985 | Bauder | 123/196 |
| 4,773,366 | | 9/1988 | Seidl et al. | 123/196 |
| 4,909,203 | | 3/1990 | Fukuo | 123/196 |
| 4,986,235 | | 1/1991 | Ishii et al. | 123/195 |
| 5,456,227 | | 10/1995 | Shimmell et al. | 123/195 |
| 5,479,886 | | 1/1996 | Leonard et al. | 123/196 |
| 5,653,205 | * | 8/1997 | Ozeki | 123/196 R |

FOREIGN PATENT DOCUMENTS

| | | |
|---|---|---|
| 0 560 2030 | 9/1993 | (EP) . |
| 2235725 | 3/1991 | (GB) . |

* cited by examiner

*Primary Examiner*—John Kwon
(74) *Attorney, Agent, or Firm*—Alan J. Hickman

(57) ABSTRACT

An internal combustion engine (10) having an oil sump (12) mounted below an engine block (14), the engine block accommodating a crankshaft (16) and its associated connecting rods (18) wherein the engine includes a barrier (24) located at a position adjacent a lowermost point in the sweep of a big end (20, 22) of one of said connecting rods, the barrier being dedicated to the connecting rod and acting to restrict oil contained in the sump reaching the vicinity of the connecting rod big end during a lowermost portion of its sweep.

12 Claims, 3 Drawing Sheets

INTERNAL COMBUSTION ENGINE HAVING AN INCREASED LUBRICATING OIL CAPACITY AND/OR INCREASED GRADIABILITY

BACKGROUND OF THE INVENTION

1. Field of the Invention

The present invention generally relates to internal combustion (i.c.) engines and, in particular, to internal combustion engines having an increased lubrication oil capacity and/or gradiability.

Oil sumps on i.c. engines are required to contain oil for the lubricating requirements of the engine under a wide variety of engine operating conditions. The quantity of oil required to be contained in the sump depends upon a number of factors including the type of duty for which the engine is to be used, the shortest acceptable servicing interval, the engine size, the environment in which the engine is to be operated and the cooling effect of oil flowing through and around the components of the engine.

In particular, the constant move towards higher specific power outputs and wider servicing intervals places demands on the lubricating and cooling performance of the engine oil which are increasingly difficult to satisfy without enlarging the engine oil capacity. An increase in the oil capacity of an engine can benefit servicing intervals because there will be a larger volume to accept a given quantity of contaminants. A larger capacity can also reduce engine operating temperatures to the benefit of both oil life and engine components such as crankshaft bearings.

In modern diesel engines, it is known to retard fuel injection timing by predetermined amounts. This can lead to greater soot contamination of lubricating oil.

Increasing the oil capacity of the sump can redress this problem and even allow the service interval for oil changeover to be increased.

Enlarging the oil capacity by increasing the maximum level in a sump can, however, have very undesirable effects. The main problem is the increased possibility for windage, this being a tendency for the sweep of a crankshaft journal and its associated connecting rod big end to pick up oil from the sump and throw it around the inside of the engine, thereby increasing oil temperature, oil consumption and emissions and reducing engine efficiency. Windage can occur even where the sweep of the connecting rod big end is above, but close to, the sump oil level.

A commonly adopted practice to permit the raising of the maximum oil level in a sump, and thereby the oil holding capacity, is to provide a perforated baffle or 'windage tray' between the crankshaft and the surface of the oil in the sump. However, whilst this will assist in reducing windage when the engine is running at a normal horizontal inclination, windage can still occur when the engine is inclined above the horizontal inclination or when inertial forces resulting from vehicle direction changes cause oil to translocate from beneath to above the baffle through its perforations.

2. Description of the Related Art

U.S. Pat. No. 3,100,028 teaches increasing the oil capacity of an i.c. engine by extending a lower portion of a sump in an outward direction. However, this increase in width inevitably leads to an increase in the engine envelope size and can result in the sump wings fouling the vehicle chassis or bodywork.

An alternative means of increasing the oil capacity of an engine whilst reducing the risk of windage is disclosed in U.S. Pat. No. 5,479,886 wherein it is taught to provide restrictions against oil return to the sump from upper regions of the engine so that these upper regions act as supplementary oil reservoirs during engine operation. The restriction to oil return to the sump from the upper regions is brought about by compelling the oil to negotiate a number of small diameter drain holes.

A further restriction to oil return is taught in U.S. Pat. No. 5,479,886, namely the inclusion, in upper regions of the engine, of oil retaining chambers from which oil cannot drain back to the sump irrespective of whether the engine is operating or not.

The teaching of this latter prior art reference has several drawbacks. Firstly, the small drain holes may become blocked with the products of combustion or other foreign material contaminating the oil and thus prevent oil returning to the sump. Secondly, when the engine is due for servicing it will have to stand for some considerable time after being operated to allow the oil to drain to a removal point. This standing time could be lengthy if the oil has not thoroughly warmed and is therefore of a high viscosity. There is therefore a risk of new oil being introduced before the old oil has been substantially removed. Thirdly, no means is disclosed in U.S. Pat. No. 5,479,886 to ensure that the oil deliberately trapped by the non-draining oil chambers is free of contaminants, such as the residues of combustion, which may be released into the 'clean' lubricating oil subsequent to an oil change.

The problem of providing an engine with a high oil capacity is exacerbated by the requirement for some engines to operate at steep inclinations above the horizontal such as is experienced in earthmoving equipment or lifeboat vessels. The tendency for windage in an engine escalates as the angle of operation increases and will be particularly noticeable at a lower end of an inclined engine because the sump oil level will have been brought into closer proximity to the rotating crankshaft. In such a case, the maximum operating angle is dependent upon the angle at which windage will commence at a lower end of the engine.

A further problem is the difficulty in indicating to the operators of equipment the point at which the limit of allowable engine operating inclination has been reached. The limiting angle is commonly lower than the angle which an operator would wish to operate the equipment at, therefore the lower the designated maximum angle of operation, the greater the risk of it being exceeded. A comparatively low maximum angle not only restricts the use of the equipment but also increases the risk of abuse of the intended maximum angle and if this abuse introduces windage, it may well lead to overheating, increased emissions and increased oil consumption in the engine.

OBJECTS AND SUMMARY OF THE INVENTION

The present invention is directed to overcoming one or more of the problems as set forth above.

According to the present invention there is provided an internal combustion engine having an oil sump mounted below an engine block, said engine block accommodating a crankshaft and its associated connecting rods, wherein the engine includes a barrier means located at a position adjacent a lowermost point in the sweep of a big end of one of said connecting rods, said barrier means being dedicated to the said connecting rod and acting to restrict oil contained in the sump reaching the vicinity of the connecting rod big end during a lowermost portion of its sweep.

BRIEF DESCRIPTION OF THE DRAWING

The features of the present invention will be more readily understood from the following description of preferred embodiments, by way of example thereof, with reference to the accompanying drawings, of which.

DESCRIPTION OF THE PREFERRED EMBODIMENTS

Figure 1:
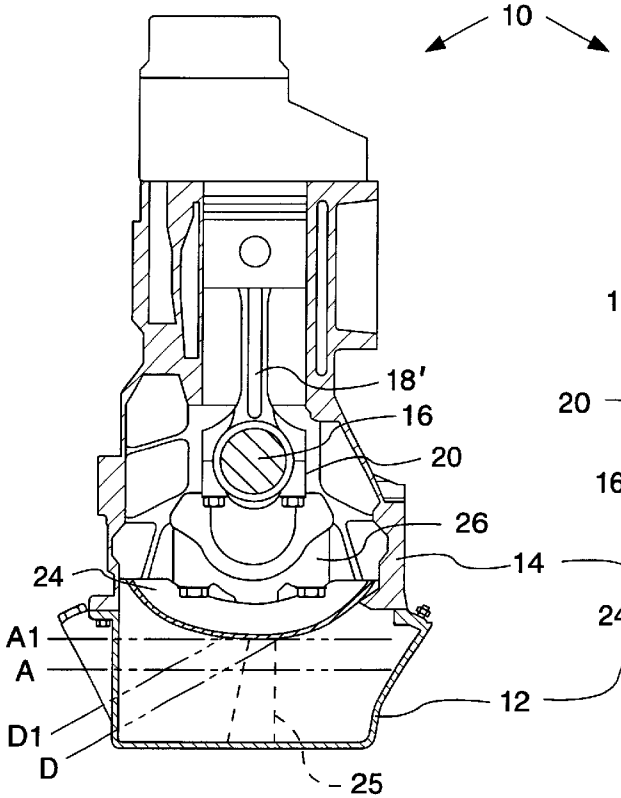
FIG. 1 is a cross-sectional end view of an embodiment of an i.c. engine in accordance with the invention illustrating an increased sump oil capacity.

Referring to the drawings, FIG. 1 is a cross-sectional end view of an engine 10 in which it may be desired to raise the maximum sump oil level to give increased service intervals or improvements in engine or lubricating oil life but without also increasing the occurrence of oil windage. The engine 10 is fitted with a conventional oil sump 12, which acts as a reservoir for the engine oil. The sump 12 is mounted on the engine block 14. The engine block 14 accommodates a crankshaft 16 and its associated connecting rods 18. Line 'A' in FIG. 1 represents a designed maximum oil level that might be seen in the engine when it is in a nominally upright (horizontal) position before being fitted with the barrier device of the present invention. Line 'D' represents a corresponding oil level when the engine 10 is operated at an allowed maximum transversal angle. If the oil level in the engine is increased above the level represented in FIG. 1 by line 'A', there will be a risk of oil windage and the resulting problems described herein before when the engine is in operation. The maximum oil level represented by line 'A' will, of course, vary for different engines.

Figure 2:
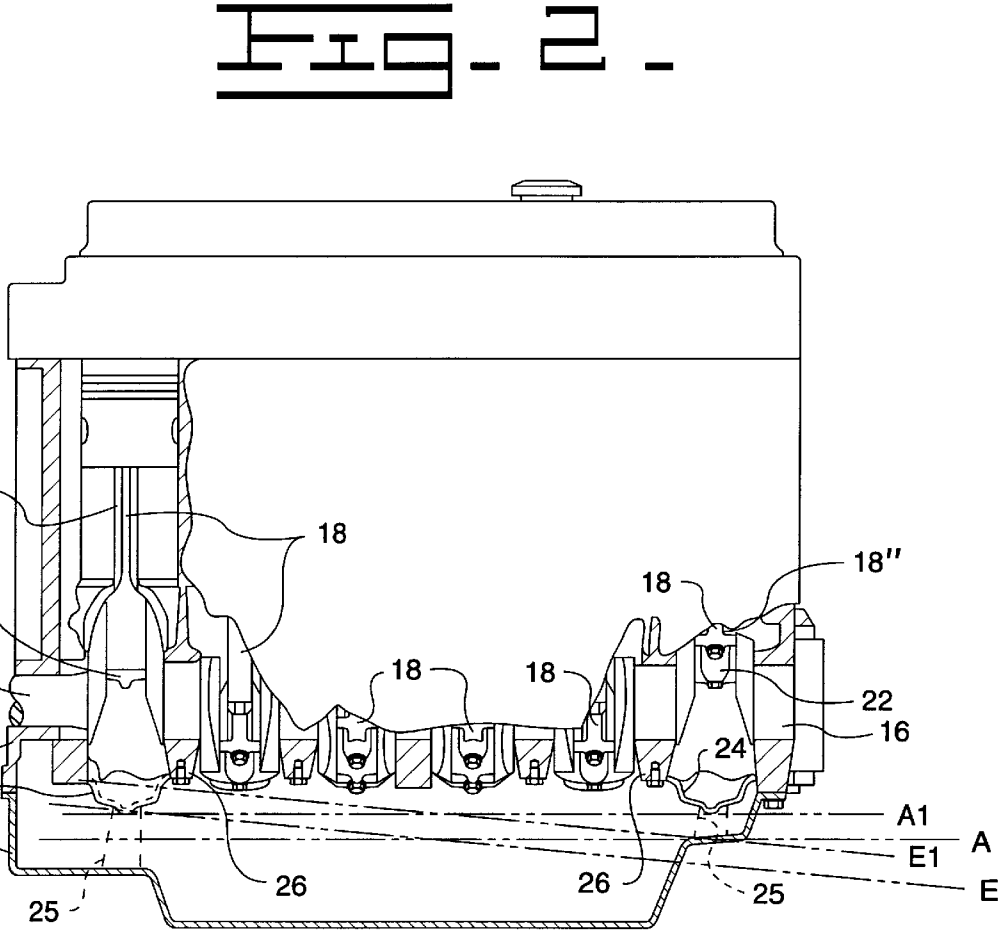
FIG. 2 is a cross-sectional side view of the engine of FIG. 1.

FIG. 2 is a cross-sectional side view of the engine shown in FIG. 1. Line 'A' again represents the designed maximum oil level when the engine is in a nominally upright position and line 'E' represents a corresponding oil level when the engine is operated at an allowed maximum longitudinal angle.

Figure 5:
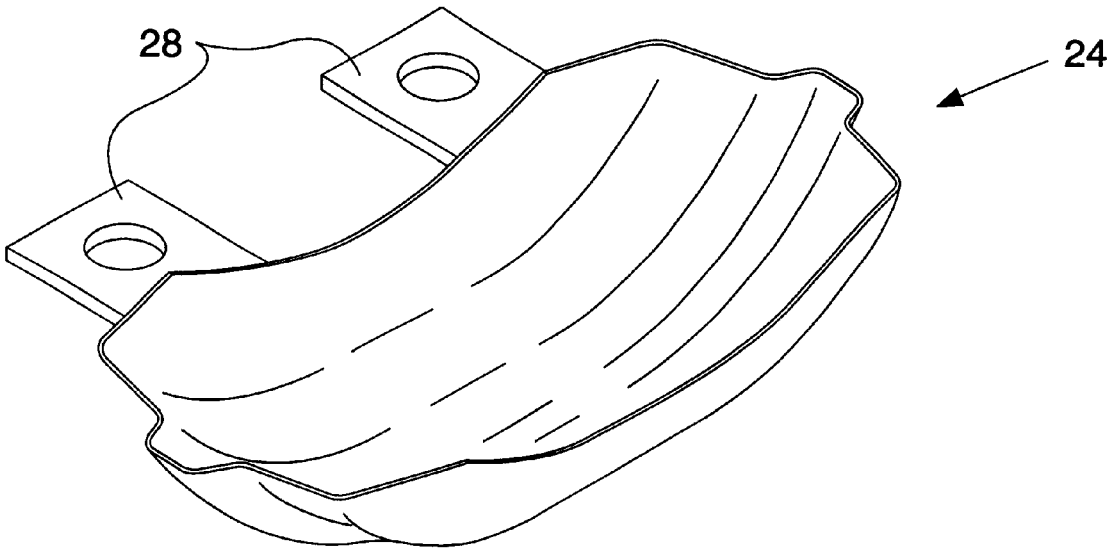
FIG. 5 is an isometric view of the barrier device of the present invention before fitting to an engine.

FIG. 5 shows the barrier device 24 of the present invention, which is generally cup-shaped. The device is a dedicated barrier, which is intended to be mounted beneath and shield a single connecting rod of the engine. In a preferred embodiment of an engine in accordance with the invention two such devices are required, one to shield a big end 20 of a first connecting rod 18' and one to shield a big end 22 of a last connecting rod 18" of the crankshaft 16 from both direct contact and windage contact with the oil carried by the sump 12 when the engine 10 is inclined transversely and/or longitudinally during operation.

Providing dedicated barriers 24 to be mounted beneath individual connecting rods of the engine minimises the increase in weight of the engine and benefits engine efficiency by only providing windage barriers in the areas where windage is most likely to occur.

Preferably, each barrier device 24 is gondola-shaped to closely follow the path of its associated big end (20, 22) of the connecting rods (18', 18") so that the big ends pass close to, but do not touch, their respective barrier devices 24. Preferably also, the barrier device 24 is retained in position by a screw fixing of a convenient engine main bearing cap 26 by means of brackets 28, although it will be appreciated that various other locating and supporting means may be used. For example, as shown in broken outline in FIGS. 1 and 2, the barrier devices 24 could be supported on and fixed to the sump 12 by mounting means 25 which could be formed integrally with the sump 12. The barrier device 24 may be formed independently, of or integrally with, the brackets 28 by stamping from a sheet metal material. Alternatively, the barrier device 24 may be formed from a plastics material and may be formed by an injection moulding process.

The maximum oil level in an engine fitted with the present invention may be provided at a higher level, shown as 'A1' in FIGS. 1 and 2, thereby substantially increasing the volume of oil that may be held within the oil sump. The increase in maximum oil level during nominal upright engine position will result in a corresponding increase in oil level during engine operation at maximum transversal and longitudinal operating angles, shown respectively by lines 'D1' and 'E1' in FIGS. 1 and 2. However, the shielding of the connecting rod path by the relevant barrier device 24 will deter oil windage by preventing sump oil reaching the vicinity of its associated big end (20, 22) during a lowermost portion of the sweep of the big end (20, 22).

There tends not to be copious amounts of oil draining down from within an engine cylinder but oil caught by the barrier devices 24 as a result of oil splash or drain will be purged by the sweeping movement of the connecting rod big end (20, 22) and its corresponding crankshaft journal. This will ensure that contaminants do not become concentrated within the devices 24 and hence contaminate new oil introduced during an engine oil change.

The present invention allows the volume of oil which can be carried by the oil sump 12 of an engine 10 to be increased and this, in turn, provides longer engine service intervals and reduced engine oil temperature elevation during arduous engine operation. The increase in the oil capacity of the sump will be in the range of 20% to 40%.

Figures 3, 4:
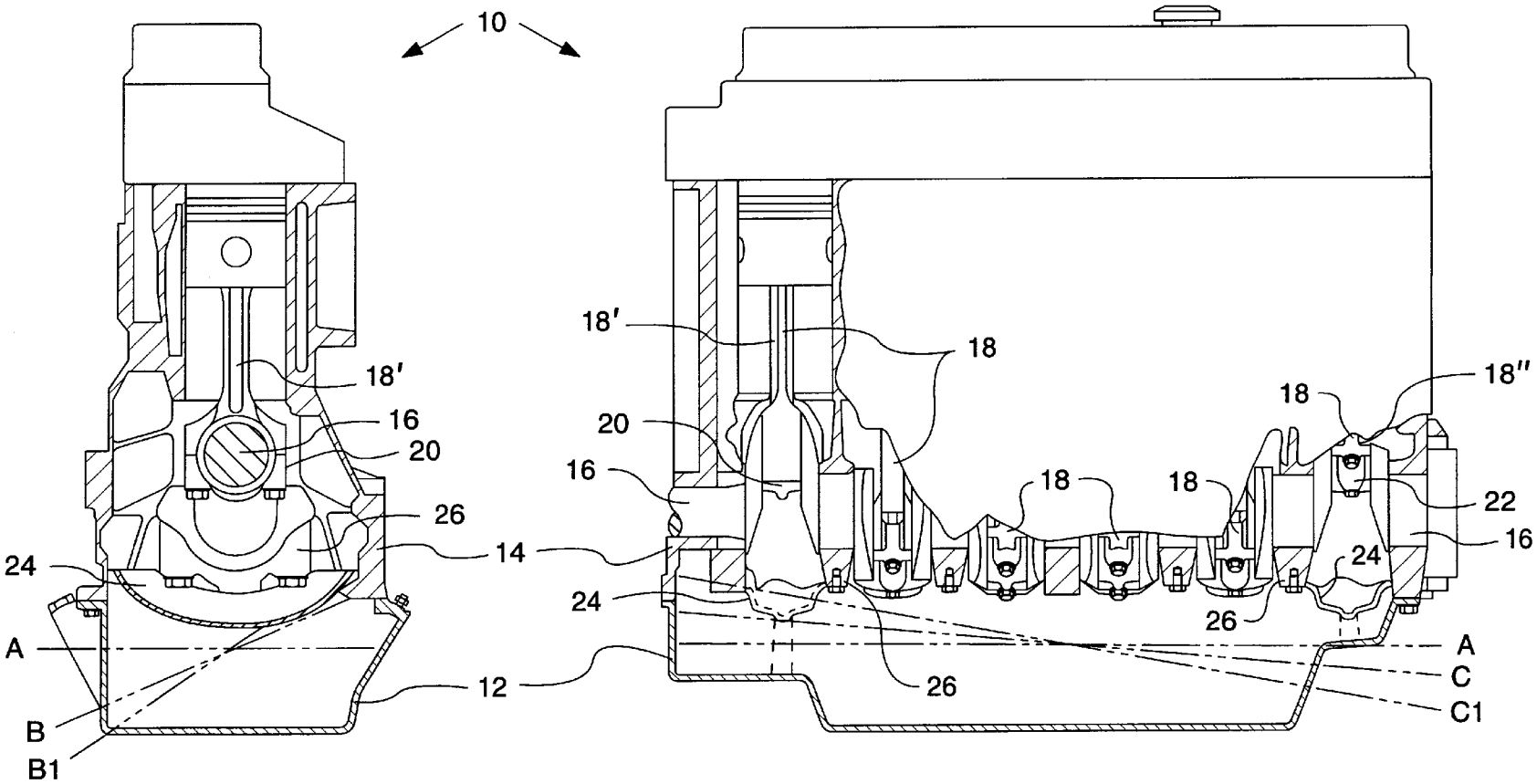
FIG. 3 is a cross-sectional end view of the embodiment of the i.c. engine in accordance with the invention illustrating an increased gradiability.
FIG. 4 is a cross-sectional side view of the engine of FIG. 3.

FIGS. 3 and 4 show the i.c. engine 10 in accordance with the present invention illustrating that the engine 10 can be angled transversely and/or longitudinally to a greater extend than is possible with the same engine not including barrier devices 24 in accordance with the invention without the need to reduce the quantity of oil in the sump in order to avoid windage.

In some end uses, lifeboats for example, it may be very important for an engine to be able to withstand very high gradient operations without oil windage but, whilst the extended servicing intervals and other benefits provided by the present indention may not be essential in this case, it may be desirable to at least maintain a sump oil capacity similar to that which lesser-duty engines enjoy. The arrangement illustrated by FIGS. 3 and 4 provides an improvement in this respect.

In FIGS. 3 and 4, Line 'A' again represents the designed maximum oil level that might be seen in an engine in the nominally upright position. The maximum oil level is intended to remain at or about line 'A' and two barrier devices 24 are fitted to shield a first and a last connecting rod big end (20, 22) as described above.

This arrangement will permit notably increased engine operating angles before the onset of windage. Lines 'B' and 'C' represent typical maximum transversal and longitudinal operating angles in normal practice whilst line 'B1' and 'C1' represent the corresponding angles that may be obtained with the present invention.

The present invention will provide an increase in the permitted transversal and/or longitudinal angle of operation of an engine by an amount in the range of 10° to 200°.

Whilst, for simplicity, the benefits of the present invention have been described in relation to one transversal and one longitudinal direction of engine inclination, it will be clear that the present invention permits the engine to be angled by similar amounts in the opposite directions of inclination with similar benefits.

It will also be appreciated that for some engines it will only be necessary to employ one barrier device to shield one connecting rod big end at one end of the crankshaft and that, for other engines, it may be advantageous to employ more that two barrier devices and even one for each connecting rod big end. This enables the total weight of the engine to be closely controlled as there is no need to provide a windage tray that extends the full length of the engine block as in the known prior art cases. In this was, the efficiency of the engine can be increased whilst the overall cost of the engine is reduced.

The present invention can be quickly and simply retrofitted to existing engines and will have an immediate effect on the efficiency of the engine without notably impairing the free draining of oil from upper parts of the engine into the oil sump.

The present invention also lends itself to easy maintenance and repair as the barrier device can be easily removed from the engine and repaired or replaced as necessary. This reduces the down time of the engine during maintenance and therefore increases the efficiency of the engine during operation.

What is claimed is:

1. An internal combustion engine; comprising:

an engine block;

an oil sump connected to the engine block, said oil sump being located elevationally below the engine block;

a crankshaft rotatively connected to said engine block;

a plurality of connecting rods each having a big end and being pivotally connected at spaced locations to said crankshaft, said big end of each connecting rod moving in a sweeping path with rotation of the crankshaft and defining a lowermost portion of the sweeping path of movement of the big end of each of said connecting rods, said lowermost portion having a lowermost point closest to the oil sump;

a plurality of spaced apart barrier devices each having a curved cross-sectional shape taken in a plane parallel to a longitudinal axis of rotation of the crankshaft, said barrier devices each being located adjacent a different one of the connecting rods and positioned between the oil sump and the lowermost point in the sweeping path of movement of said big end of the adjacent connecting rod, said barrier devices extending about, the big end of the adjacent connecting rod toward the crankshaft, said plurality of barrier devices each being dedicated to shielding the big end of only said adjacent connecting rod and restricting an oil contained in the oil sump at a level above the lowermost point in the sweeping path of said big end from reaching the vicinity of the big end of said adjacent connecting rod at the lowermost point of said adjacent connecting rod.

2. An internal combustion engine as claimed in claim 1, wherein the barrier device generally encloses a zone surrounding the lowermost portion of the sweeping path of movement of the one connecting rod big end adjacent the lowermost point.

3. An internal combustion engine as claimed in claim 2, wherein the barrier device has a shape which closely follows the lowermost portion of the sweeping path of movement of the big end of the one connecting rod.

4. An internal combustion engine as claimed claim 2, wherein the barrier device is generally cup-shaped.

5. An internal combustion engine as claimed in claim 4, wherein the barrier device is generally gondola shaped.

6. An internal combustion engine as claimed claim 2, wherein the barrier device is formed by stamping from a sheet material.

7. An internal combustion engine as claimed in claim 2, wherein the barrier device is connected by bracket means to the engine block.

8. An internal combustion engine as claimed in claim 7, wherein the barrier device is connected by bracket means to a main bearing cap of the engine block.

9. An internal combustion engine as claimed in claim 2, wherein the barrier device is connected on the sump.

10. An internal combustion engine as claimed in claim 9, wherein said barrier device being formed integrally with the sump.

11. An internal combustion engine as claimed in claim 1, wherein the crankshaft has opposite ends, a one of the plurality of connecting rods being connected to a one of the opposite ends of the crankshaft and an other of the plurality of connecting rods being connected to an other of said opposite ends of said crank shaft, a one of said plurality of barrier devices being located adjacent said one connecting rod and an other of said barrier devices being located adjacent the other connecting rod.

12. A method of operating an internal combustion engine having an oil sump mounted elevationally below an engine block at a normal inclination of said internal combustion engine, a crankshaft rotatably supported in the engine block, a plurality of connecting rods each having a big end pivotally connected to said crankshaft at longitudinally spaced apart locations, and a barrier device located at a predetermined position adjacent at least a predetermined one of said connecting rods and between big end of said one connecting rod and said oil sump, said barrier device having a curved cross-sectional shape taken in a plane parallel to a longitudinal axis of rotation of the crankshaft and being disposed about the big end of said one connecting rod, said barrier device extending elevationally toward the crankshaft between a lowermost point and a highermost point relative to said oil sump and being connected to the engine block, including the steps of:

providing an oil level in said oil sump at a level between the lowermost point and the highermost point of the barrier device when the engine is at said normal inclination;

rotating said crankshaft;

moving the big end of said one connecting rod in a sweeping path through a lowermost portion of sweeping motion relative to said oil sump located between said lowermost point and said highermost point of said barrier device; and restricting oil contained in the sump from reaching the vicinity of the one connecting rod big end during sweeping movement of the connecting rod big end through the lowermost portion.

* * * * *